US006062755A

United States Patent [19]

Huang

[11] Patent Number: 6,062,755

[45] Date of Patent: May 16, 2000

[54] COMBINATION PEN CASING

[76] Inventor: Hsien-Tu Huang, No. 56 Min Sheng Street, Feng-Yuan City 42041, Taiwan

[21] Appl. No.: 09/321,670

[22] Filed: May 28, 1999

[51] Int. Cl.[7] ..... B43K 19/14

[52] U.S. Cl. ..... 401/97; 401/96; 401/57

[58] Field of Search ..... 401/97, 96, 52, 401/56, 57, 63, 65, 82, 85, 86, 87, 90

[56] References Cited

U.S. PATENT DOCUMENTS

| | | | |
|---|---|---|---|
| 2,493,892 | 1/1950 | McPhee | 401/97 |
| 5,791,798 | 8/1998 | Yu | 401/97 |

FOREIGN PATENT DOCUMENTS

| | | | |
|---|---|---|---|
| 926249 | 9/1947 | France | 401/97 |
| 510649 | 9/1947 | United Kingdom | 401/97 |

*Primary Examiner*—David J. Walczak

[57] ABSTRACT

A combination pen casing. The casing is frictionally combined with a predetermined number of sleeves of hollow stepped taper body. The sleeves each includes a smaller diameter upper rim, a large diameter lower rim, a first, second and third neck, a right-angle portion and a first sloped surface formed on the outer periphery, a first, second and third shoulder a circular space and a second sloped surface formed on the inner periphery respectively engageable with the second and third neck, the right-angle portion and the first sloped surface, and a central bore of rough inner periphery formed in the upper rim. When the sleeves are combined, an ink cartridge, a lead or a crayon is frictionally disposed into the central bore. This pen casing is characterized in that the sleeves can be alternately moved from the front end to the rear end of the casing for repeated use so as to waste no materials.

5 Claims, 6 Drawing Sheets

COMBINATION PEN CASING

BACKGROUND OF THE INVENTION

The present invention relates to pens or pencils and more particularly to combination pen casing which is axially combined with predetermined number of sleeves to define a cylindrical receiving space in the center to frictionally receive an ink cartridge of a ball pen or a lead of pencil.

Typical pencil casing as shown in FIG. 1 which includes a hollow cylinder casing 1, a number of lead sleeves 2 combinable disposed into the casing and a lead point 3 fixedly disposed in a front end of the sleeve 2. The lead point 3 has partially jutted out of the front end and engageable into a hollow interior in the rear end of the sleeves 2. When the lead point 3 of the first sleeve 2 is finished, insert a new one into the last sleeve 3 at the rear end of the casing 1. So that the first sleeve 2 is pushed away and replaced with a second sleeve 2. The way of replacement of the lead point 3 seems easy and convenient. But it wastes materials.

As for a paper wrapped crayon, when the point of the crayon is finished, one has to tear off a part the paper to jut another part of the crayon out. This process is not easy and causes the finger contaminated with the color of the crayon. Further, when the crayon leaves behind a small part, it is difficult to handle any more, but to cast away.

SUMMARY OF THE PRESENT INVENTION

The present invention has a main object to provide a Combination pen casing which is combined with a predetermined number of tapered sleeves to define a cylindrical receiving space in the canter for receiving an ink cartridge of a ball pen, a lead of a pencil or a crayon. Because the sleeves can alternate from the front end to the rear end of the casing to coordinate with the consumption of the point so that it causes no waste of materials.

The present invention will become more fully understood by reference to the following detailed description thereof when read in conjunction with the attached drawings.

DETAILED DESCRIPTION OF THE PREFERRED EMBODIMENT

Figure 1:
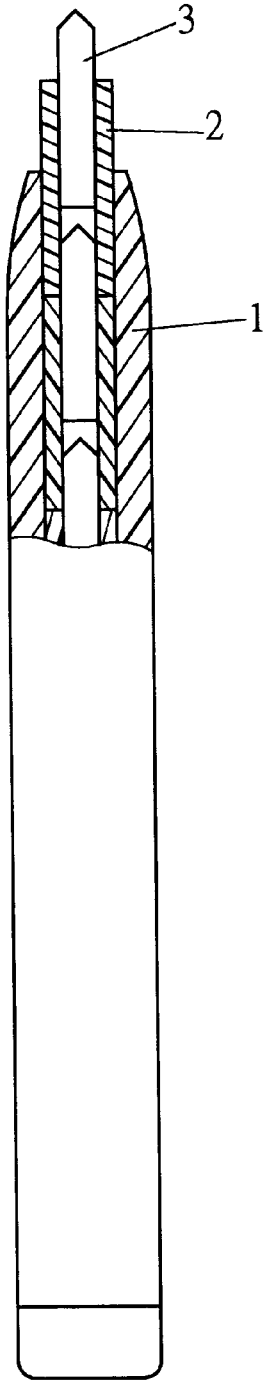
FIG.1 (Prior Art)
FIG. 1 is a sectional view to show a combination pencil of a prior art.
Figure 2:
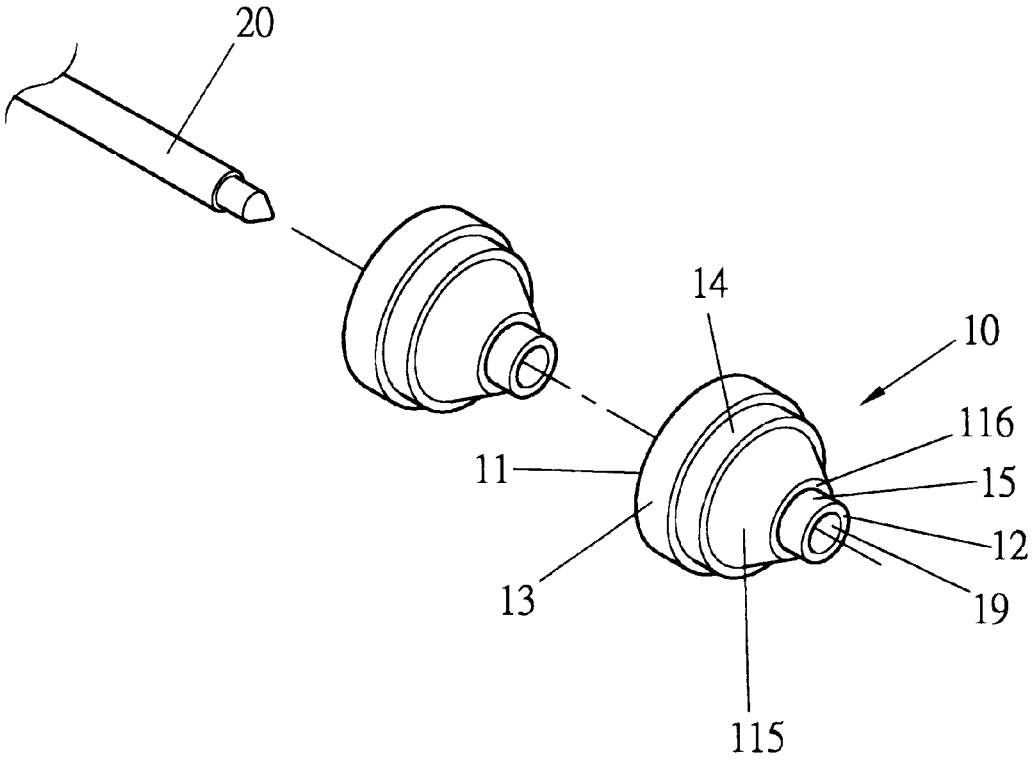
FIG. 2 is an exploded perspective view to show a combination pen of the present invention.
Figure 3:
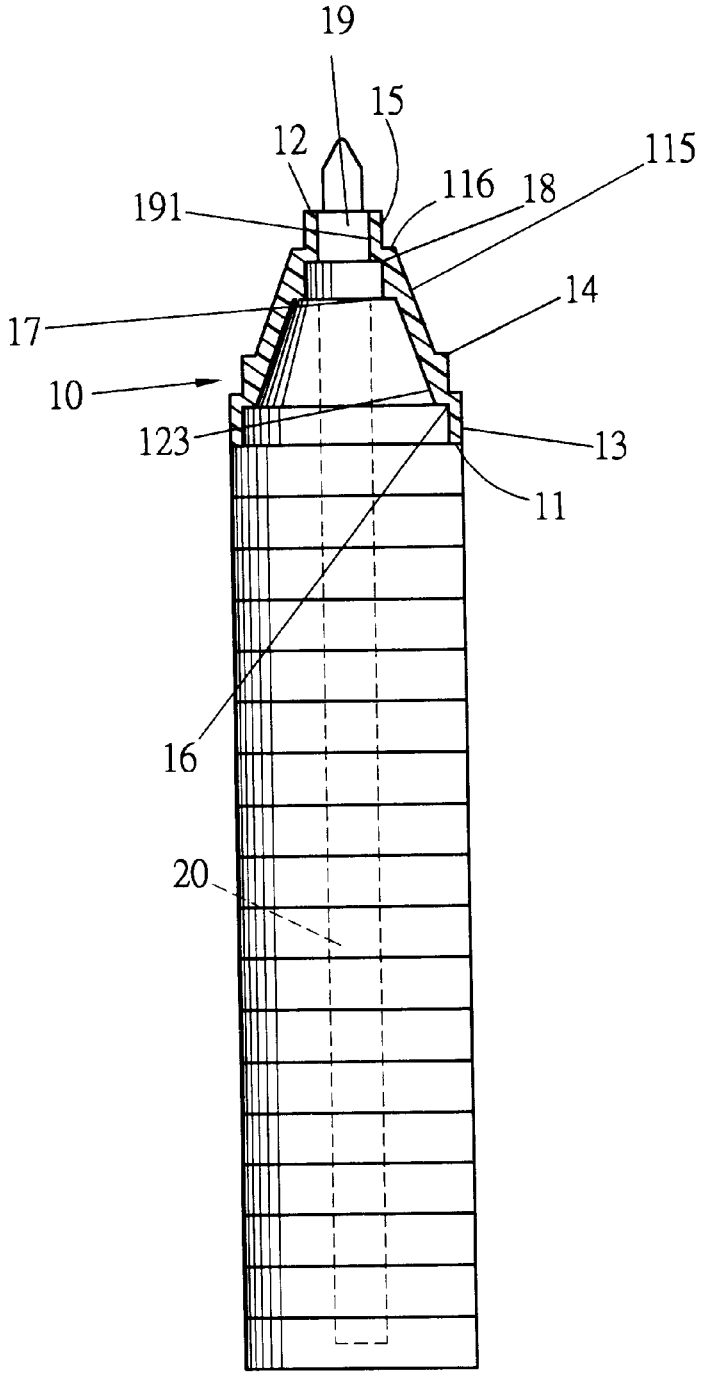
FIG. 3 is a perspective view with partially sectional view to show a combined combination pen casing of FIG. 2.
Figure 4:
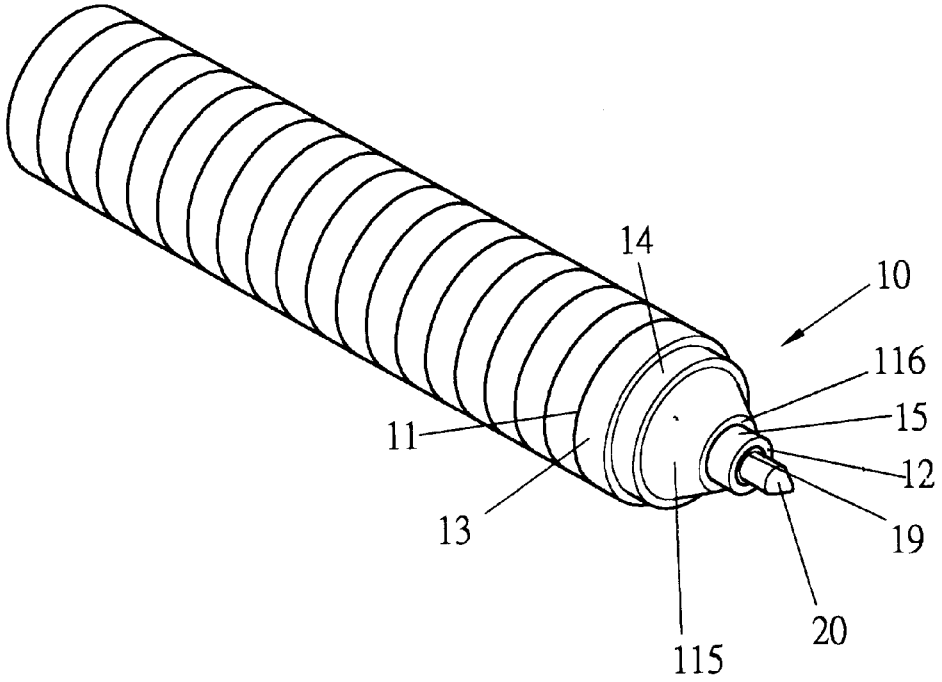
FIG. 4 is a perspective view of the outlook of FIG. 3.

With reference to FIGS. 2, 3 and 4 of the drawings, the combination pen casing of the present invention comprises a predetermined number of frictionally combinable sleeves 10 of hollow stepped taper body. Each of the sleeves 10 includes a large diameter lower rim 11, a small diameter upper rim 12, a first neck 13 abutting the lower rim 11 which becomes a handle surface when the sleeves 10 is combined together, a second neck 14 above the first neck 13 and diametrically smaller than the first neck 13, a third neck 15 formed between the upper rim 12 and a right-angle portion 116 so that a sloped outer surface 115 is defined between the right-angle portion 116 and the second neck 14. In the inner periphery of the sleeve 10, there are a first shoulder 16 formed above the lower rim 11 and engageable with the second neck 14 of an adjacent sleeve, a second shoulder 17 formed on the upper portion of a sloped inner surface 123 and engageable with the right-angle portion 116 of an adjacent sleeve and a third shoulder 18 formed above the second shoulder 17 to define a circular space between the second and third shoulder 17 and 18 engageable with the third neck 15 of an adjacent sleeve. Further, a central bore 19 formed in the third neck 15 including a rough or splined inner surface 191 so as to be able to frictionally engage with an ink cartridge, a lead or a crayon 20 therein. FIGS. 3 and 4 shown the well combined sleeves 10 of the combination pen casing of the present invention. If an ink cartridge of a ball pen is disposed in the central bore 19, the combined sleeve 10 may remain unmoved until that cartridge is replaced with a new one after the ink is finished. However, if a lead or a crayon is disposed, after the point of the lead or crayon is finished, the user may take a first sleeve 10 apart from the front end of the casing and alternate it into the first sleeve 10 at the rear end of the casing, so that another part of the lead or crayon is jutted out. This process can be done repeatedly until that the lead or crayon is totally finished and the sleeves 10 remain combined with each other.

Based on the above discussed arrangement, we are understood that both the sleeves 10 and the lead or crayon 20 will not cast away therefore wasting no materials.

Figure 5:
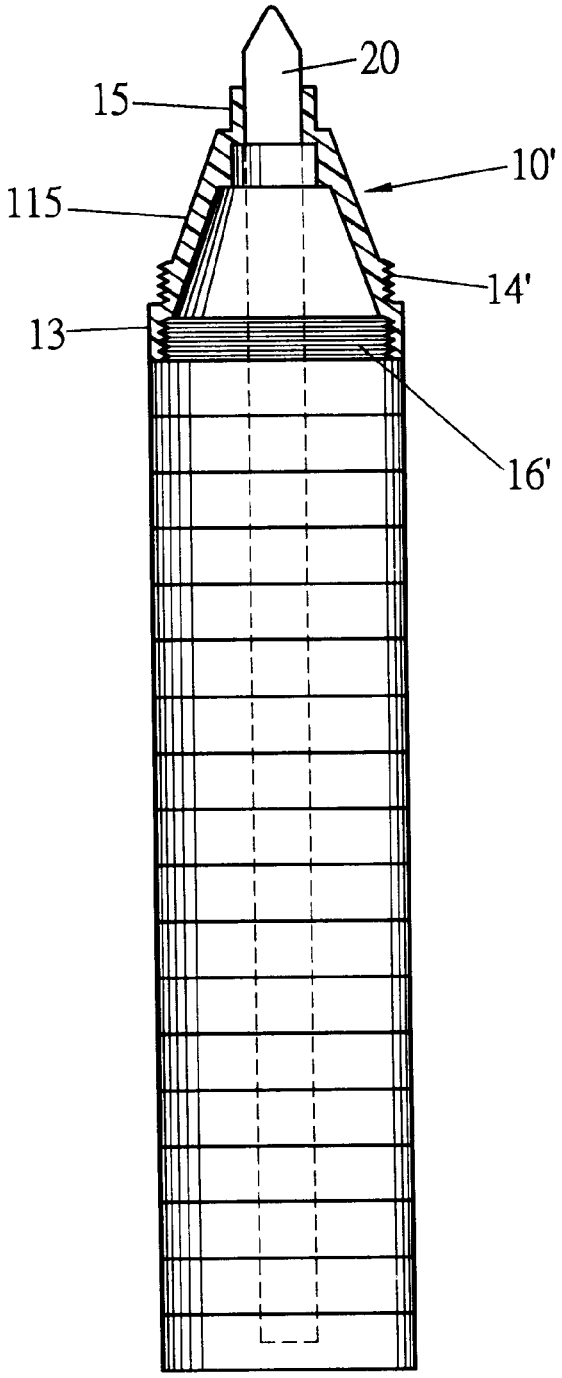
FIG. 5 is a perspective view with partially sectionally view to show an alternative embodiment of the combination pen casing of the present invention.

Referring to FIG. 5, an alternate embodiment of the sleeve 10' is provided in which the structure and function are mostly similar to the above embodiment as described in FIGS. 2 to 4, and the above discussions are applicable in the most instances.

The only change is that the second neck 14 is now replaced with threaded second neck 14' and the inner periphery between the lower rim 11 and the first shoulder 16 has formed corresponding thread 16' engageable with the threaded second neck 14'. Upon such modification, the sleeve 10' should be screwed together during the combination. However, it would be more reliable and durable.

Figure 6:
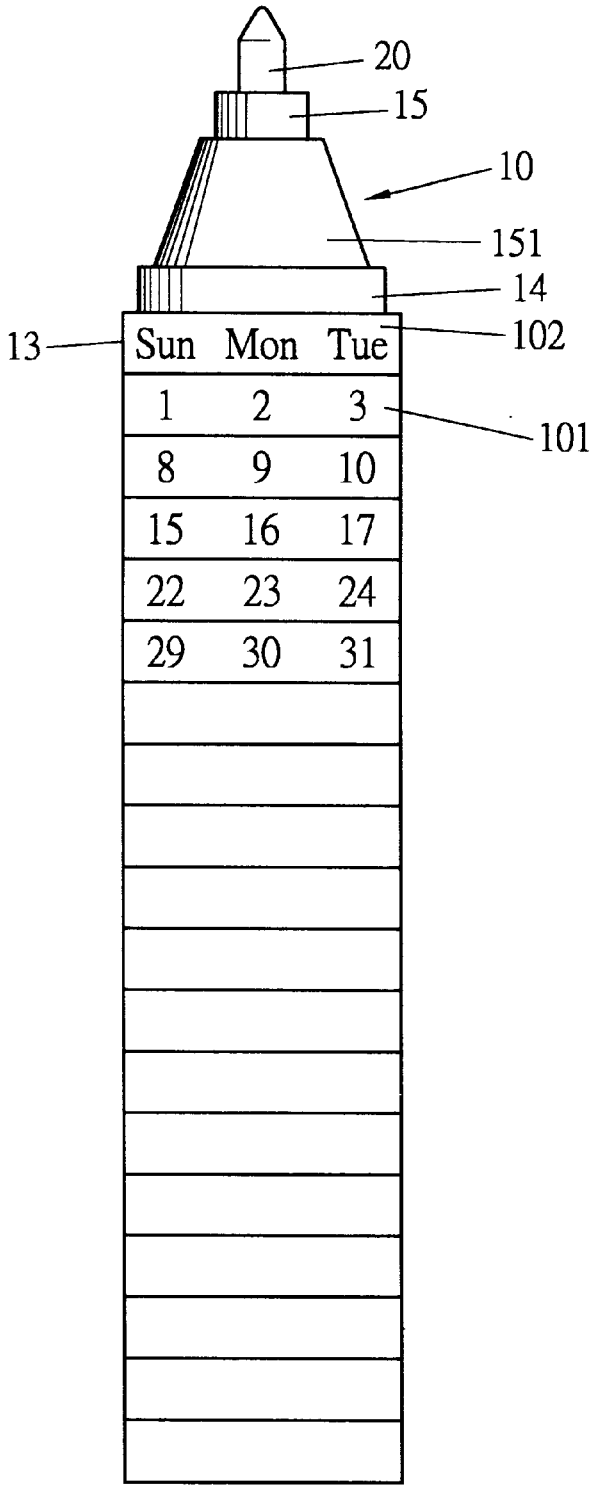
FIG. 6 is a perspective view a combined combination pen casing on the outer periphery of which the calendar is printed.

Referring to FIG. 6, it shows that the calendar 101 and/or 102 may printed in series on the outer periphery of the first neck 13 of each of the sleeve 10 or 10'. In this instance, only the week days are printed. However, it may print alternately the days of the months or the attractive patterns.

The specification relating to the above embodiments should be construed as exemplary rather as limitative of the present invention, with many variations and modifications being attainable by a person of average skill in the art without departing from the spirit or scope thereof as defined by the appended claims and their legal equivalents.

I claim:

1. A combination pen casing comprising:

a plurality of frictionally combinable sleeves and a pen core frictionally disposed through a center thereof;

said sleeves each comprising a hollow body, a small diameter upper rim, a large diameter lower rim, an outer periphery and an inner periphery;

a first neck formed on the outer periphery abutting the lower rim;

a second neck formed on the outer periphery above the first neck and having a diameter smaller than that of the first neck;

a third neck formed on the outer periphery beneath the upper rim and remote from the second neck and having a diameter smaller than that of the second neck;

a right-angle portion formed on the outer periphery beneath the third neck having a diameter slightly larger than that of the third neck;

a sloped outer surface formed on the outer periphery between the right-angle portion and the second neck;

a first shoulder formed on the inner periphery adjacent the lower rim and engageable with the second neck of a adjacent sleeve;

a second should formed on the inner periphery remote from the first shoulder and engageable with the right-angle portion of an adjacent sleeve;

a sloped inner surface formed on the inner periphery between the first and second shoulder and engageable with the sloped outer surface of an adjacent sleeve;

a central bore of rough inner periphery formed in the upper rim for frictionally engaging with the pen core;

a third shoulder formed beneath the central bore engageable with the upper rim of an adjacent sleeve; and a circular space formed on the inner periphery between the second and third shoulder engagable with the third neck of an adjacent sleeve.

2. The combination pen casing as recited in claim 1 wherein said pen core is an ink cartridge, a lead or a crayon.

3. The combination pen casing as recited in claim 1 wherein said first neck becomes a handle of the casing after said sleeves are combined.

4. The combination pen casing as recited in claim 1 wherein said sleeve further includes threads on said second neck engageable with a threaded inner surface on the inner periphery of the sleeve between the first shoulder and the lower rim thereof.

5. The combination pen casing as recited in claim 1 wherein said first neck may be printed with calendar and attractive patterns on outer periphery thereof.

* * * * *